US006291750B1

(12) United States Patent
Farha

(10) Patent No.: US 6,291,750 B1
(45) Date of Patent: Sep. 18, 2001

(54) BRIDGE FOR A VIOLIN OR VIOLA SHOULDER REST

(75) Inventor: Juliana Farha, Toronto (CA)

(73) Assignee: The Kun Shoulder Rest Inc., Ottawa (CA)

( * ) Notice: Subject to any disclaimer, the term of this patent is extended or adjusted under 35 U.S.C. 154(b) by 0 days.

(21) Appl. No.: 09/501,264

(22) Filed: Feb. 9, 2000

(30) Foreign Application Priority Data

Feb. 22, 1999 (CA) ..... 2262290

(51) Int. Cl.[7] ..... G10D 1/02
(52) U.S. Cl. ..... 84/278; 84/279; 84/280
(58) Field of Search ..... 84/278, 279, 291, 84/280

(56) References Cited

U.S. PATENT DOCUMENTS

| | | | | |
|---|---|---|---|---|
| 168,665 | * | 10/1875 | Oehrlein | 84/291 |
| 1,879,386 | | 9/1932 | Medakovic | 84/280 |
| 2,064,925 | | 12/1936 | Kolitsch | 84/280 |
| 2,489,101 | | 11/1949 | Mills | 84/280 |
| 2,591,164 | | 4/1952 | Klein | 84/280 |
| 2,747,452 | | 5/1956 | Goldberger | 84/280 |
| 4,333,378 | * | 6/1982 | Hrdlicka | 84/280 |
| 4,646,613 | | 3/1987 | Banchetti | 84/327 |
| 5,333,527 | * | 8/1994 | Janes et al. | 84/291 |
| 5,576,082 | | 11/1996 | Jarrett | 428/36.91 |
| 5,731,531 | * | 3/1998 | Kun | 84/280 |
| 6,031,163 | * | 2/2000 | Cullum et al. | 84/279 |

* cited by examiner

*Primary Examiner*—Shih-Yung Hsieh
(74) *Attorney, Agent, or Firm*—Stevens, Davis, Miller & Mosher, LLP

(57) ABSTRACT

The disclosed bridge (10) of a violin or viola shoulder rest is made from a laminate of wood veneers (23–29) the grain of which alternates generally at right angles to each other. In the embodiment disclosed, the number of veneers is seven. The top veneer (23) and the bottom veneer (29) have their grain oriented generally longitudinally of the bridge (10).

15 Claims, 3 Drawing Sheets

BRIDGE FOR A VIOLIN OR VIOLA SHOULDER REST

BACKGROUND OF THE INVENTION

The present invention relates to the violin or viola shoulder rests and in particular to wooden base or bridge of a violin or viola shoulder rest.

Wooden bases of violin or viola shoulder rests are known in the art. They provide attractive appearance and relatively low weight.

U.S. Pat. Nos. 1,079,386 (Medakovic), 2,064,925 (Kolitsch) and 2,489,101 (Mills) disclose the possibility of making a shoulder rest bridge from, among other materials, wood, reference. U.S. Pat. Nos. 2,591,164 (Klein) and 2,747,452 (Goldberger) disclose violin shoulder rests comprising velvet covered wooden elements.

The known wooden shoulder rests have an elongated wooden bridge or base with clamping members at each end of the base to secure the bridge to a violin. They are all made from a single piece of wood which is machined to the desired shape. Their disadvantage is that the bridge is quite stiff so that end members holding the clamps for securement to the violin are the only flexible parts that yield during the attaching of the shoulder rest to a violin. There is a tendency for such members to become loosened with the resulting disfunction of the shoulder rest. The appearance of single piece wood shoulder rest bridges is often unsatisfactory as the wood grain runs out of and into the top surface when the base is machined to become longitudinally arched as is usual with the bridge types of shoulder rests. Besides, the bases made from a single piece of wood may be unreliable as hidden structural defects may be present which go undetected until the shoulder rest is in use.

The users of violin shoulder rest usually require that the base which, in use, rests on the player's shoulder, have certain flexibility. The flexibility not only makes it more convenient to attach the shoulder rest to the violin but also provides a more comfortable support while playing of the violin. Too much flexibility, however, may cause the base member to brush against the bottom of the body of the violin during the playing, particularly if the player adjusts the height of the rest very low. Too much flexibility is also undesirable as the clamping force attaching the shoulder rest to the violin may be insufficient causing inadvertent detachment from the violin.

The object of the invention is to provide an improved shoulder rest which has a visually attractive wooden base or bridge but at the same time possesses an appropriate degree of flexibility and strength.

SUMMARY OF THE INVENTION

According to the invention the base or bridge of a violin or viola is produced as a wooden laminate. It is preferred but not absolutely essential that the uppermost veneer of the laminate have its grain oriented generally longitudinally of the bridge. Preferably, an uneven number of the layers of the wood are laminated such that the grain of the veneers alternates between a longitudinal and transverse orientation relative to the elongation of the bridge and the veneer on top of the bridge and that at the bottom of the bridge have both the grain oriented generally longitudinally from one end of the base to the other. The remaining veneer layers have their grain oriented alternately generally longitudinally and generally laterally. Those skilled in the art will appreciate that since most bridges of violin shoulder rests are shaped to a slightly arcuately curved plan contour, the grain of the veneers cannot be made exactly longitudinally even though a generally longitudinal orientation can be achieved.

In general terms and in one aspect thereof, the present invention provides, for use in making a bridge of a violin or viola shoulder rest, a wooden bridge support strip, comprising (a) an upper face portion and an opposed lower face portion, a first end portion and an opposed second end portion, and two opposed side edge portions;

(b) said upper face portion including attachment means for securement of the wooden bridge to a violin or viola;

(c) said bridge support strip being a laminate of a plurality of wood veneers including a top veneer defining said upper face, a bottom veneer defining the lowermost layer of said laminate, and at least one intermediate veneer;

(d) adjacent veneers of said laminate having their wood grain oriented alternatively generally longitudinally and generally transversely of the elongation of the bridge;

(e) said bridge support strip being longitudinally arcuately curved such that the upper face portion is generally convexly curved and the lower face portion is generally concavely curved.

In another aspect, but still defining the invention in general terms, a shoulder rest is provided for use with a violin or viola, comprising:

(a) a bridge including an upper face portion and an opposed lower face portion, a first end portion and an opposed second end portion, and two opposed side edge portions;

(b) attachment means for securement of the shoulder rest to a violin or viola, to removably maintain said bridge spaced below a body of the violin or viola and disposed generally transversely of said body;

(c) said bridge being a laminate of a plurality of wood veneers including a top veneer defining said upper face, a bottom veneer defining the lowermost layer of said laminate, and at least one intermediate veneer;

(d) adjacent veneers of said laminate having their wood grain oriented alternatively generally longitudinally and generally transversely of the elongation of the bridge; and (e) a soft padding layer fixedly secured to said bottom veneer.

BRIEF DESCRIPTION OF THE DRAWINGS

The invention will now be described by way of a prototype, with reference to the accompanying diagrammatic, not-to-scale drawings. The attachment means attaching the bridge to a violin are shown only in broken lines to indicate that a vast number of different mechanisms is well known in the art and can be used with the invention. Besides, the attachment means per se do not form a part of the inventive concept. In the drawings.

DETAILED DESCRIPTION

Figure 1:
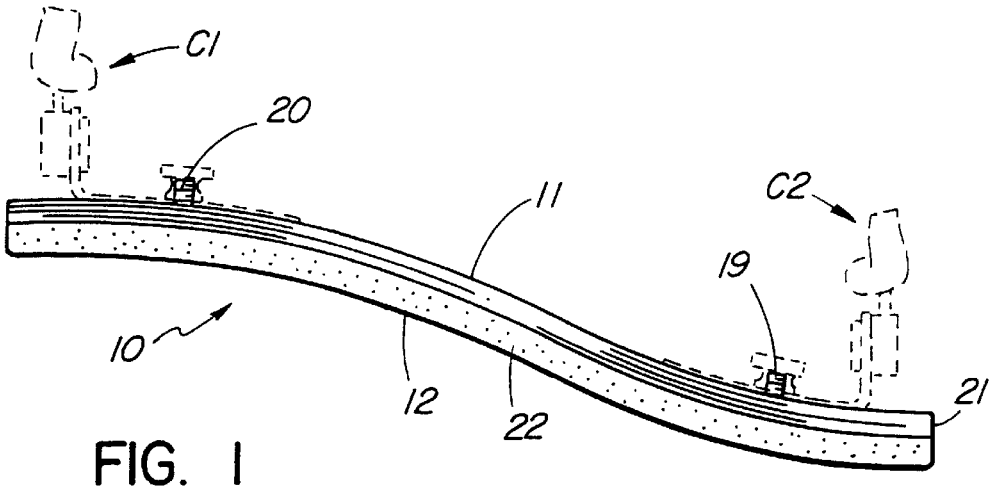
FIG. 1 is a side view of a bridge of a violin shoulder rest according to the present invention.

The bridge 10 has a generally flat, longitudinally convexly arched upper face portion 11 and an opposed lower, longitudinally concavely arched face portion 12. The bridge (FIG. 4) is of an elongated, slightly C-curved contour in plan. It has a first end portion 13 and an opposed second end portion 14. As best seen from FIGS. 1 and 2, the bridge narrows slightly in the direction from the second end portion 14 to the first end portion 13. Reference numbers 15, 16 designate the opposed side edge portions of the bridge. The contour of the side edge portion 15 is concavely curved, the contour of the opposed side edge portion 16 is convexly curved.

As is well known the ends of the bridge are configured to accommodate an appropriate attachment mechanism. There exists a vast number of known attachment mechanisms, of which the one disclosed in Canadian patent 1,290,961 (Kun), which is incorporated herein by reference, is shown in FIG. 1 as clamps C1 and C2, one at each end of the bridge 10. This mechanism, while preferred, may be substituted by many other mechanisms disclosed in prior art or obvious in view of prior art. For instance, the securement means may be fixed to the bridge at the centre of its top face. The term "attachment means" as referred to in this specification is therefore to be interpreted broadly as including many different arrangements which may differ from the embodiment disclosed.

In the present embodiment of the bridge, the attachment means also includes a shallow groove 17 at the second end portion 14 and another, similar, slightly narrower shallow groove 18 at the first end portion 13. A threaded pin 19 projects from the bottom of groove 17 and a similar threaded pin projects from the bottom of groove 18. The width of the grooves 17, 18 is compatible with the particular clamp arrangements used. In some embodiments, the grooves may be omitted.

The bridge 10 is composed of a laminate of wood veneers which form a support structure 21 of the bridge, and of a foam rubber or the like padding 22 adhesively secured to the lower face of the support structure 21, also referred to as a support strip 21.

Figure 2:
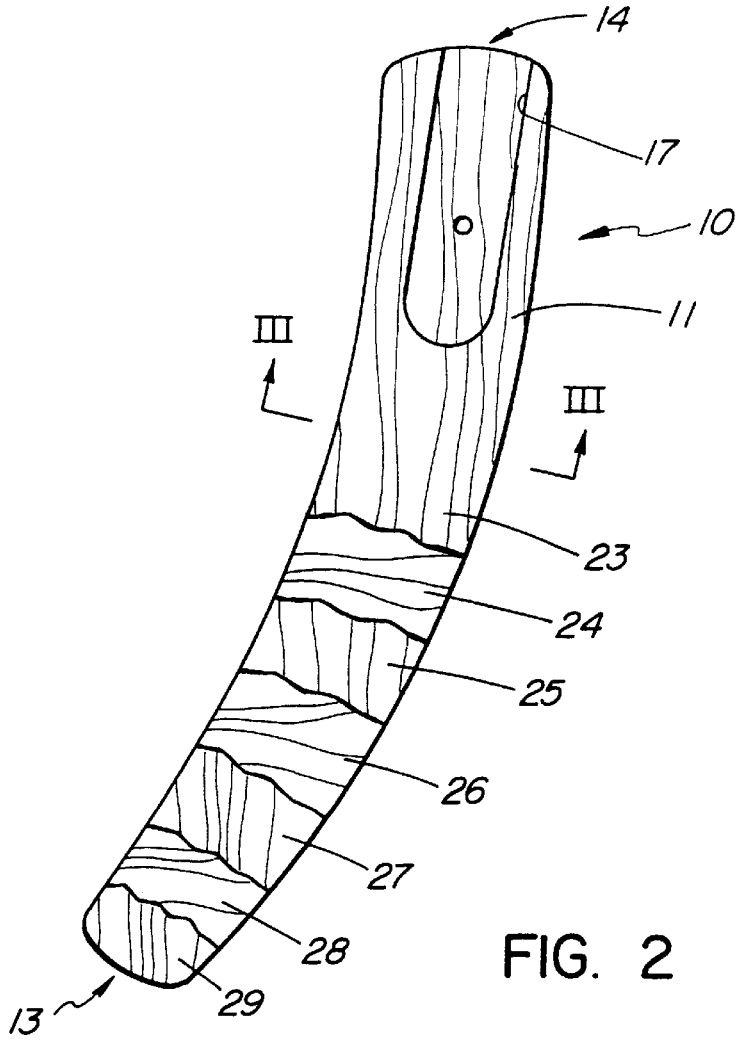
FIG. 2 is a cut-away top plan view of the bridge of FIG. 1.
Figure 3:
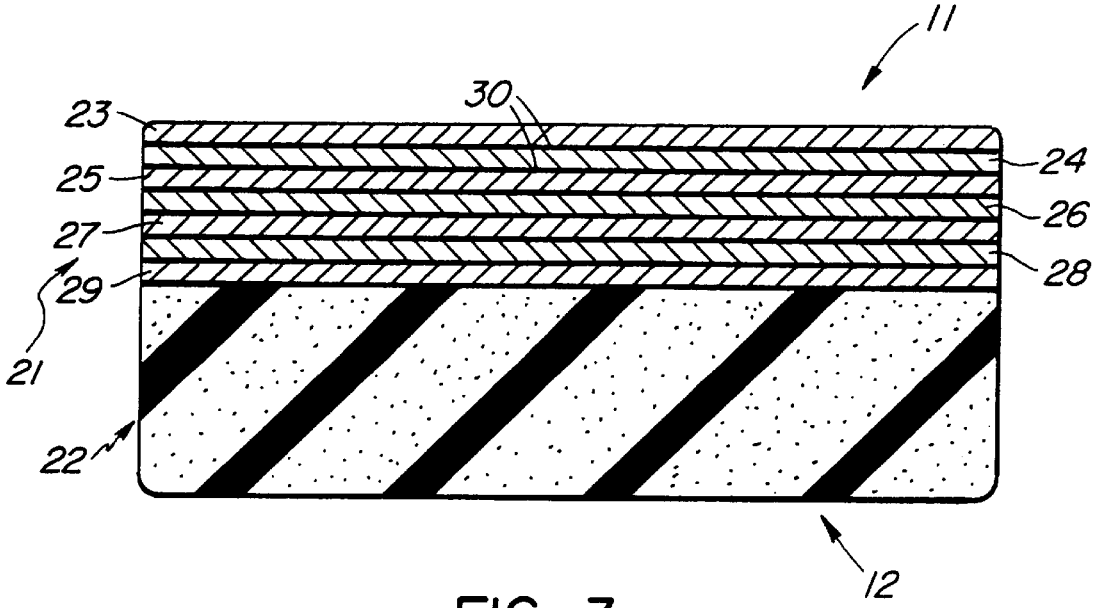
FIG. 3 is an enlarged sectional view taken along section line III—III of FIG. 2.

In the embodiment shown, the strip 21 is made from seven veneer layers or veneers 23–29 including a top veneer 23 and a bottom veneer 29, as best seen in FIGS. 2 and 3. FIG. 2 shows that the grain of adjacent veneers alternates such that the grain of one veneer, preferably the top veneer 23, extends generally longitudinally of the bridge 10, the next intermediate veneer 24 has grain oriented generally transversely, the next veneer 25 again generally longitudinally, and so on to the bottom veneer 29 the grain of which is oriented generally longitudinally of the bridge 10.

The sequence and the number of the veneers used is optional. The number may vary depending on the thickness of the veneer available, on the type of wood used and on the desired stiffness of the strip 21. The laminate of the prototype shown in the drawings is composed of seven veneers each having the thickness of about 0.025", giving a total thickness of the support strip 21 (FIG. 1) of about 0.175". The grain of the top veneer 23 is preferably oriented longitudinally of the bridge 10 as this provides a more eye pleasing effect. As the drawings show, the bridge 10 has a longitudinally arcuate, flattened S-shaped configuration. Such shape is believed to be better retained and the strength optimized if the number of the veneers having longitudinal orientation, such as veneers 23, 25, 27, 29 is greater than those with transverse orientation, such as veneers 24, 26, 28, even though, obviously, the desired strength could also be achieved by increasing the overall number of the veneers. But, as already mentioned, the number and sequence of the veneers is optional.

In the embodiment shown, the top veneer 23 of the prototype is a soft curly maple veneer, soft curly maple wood is often used for the bottom of the body of a violin. The remaining veneers 24–29 are all cherry wood. As is the case with the arrangement and number of the alternating layers of the veneers, the type of wood is also optional and a wide variety of different kinds can be used.

The diagrammatic representation of FIGS. 5A through 5E shows the manufacture of the prototype of the support strip 21.

In the first step, pre-cut rectangular sheets of veneer were prepared, each having the size of about 2.3"×10" The sheets were pre-cut such as to provide the alternating longitudinal and lateral orientation of the grain as described. The size of the pre-cut pieces, of course, depends on the desired final size of the support strip 21.

The surfaces of the pre-cut veneers were provided with a glue layer. Good results were obtained with polyvinyl acetate resin emulsion glue which is commercially available and is sold, for instance, under the name of Lee Valley Cabinetmaker's Glue-Formula 202 G.

Figure 5A:
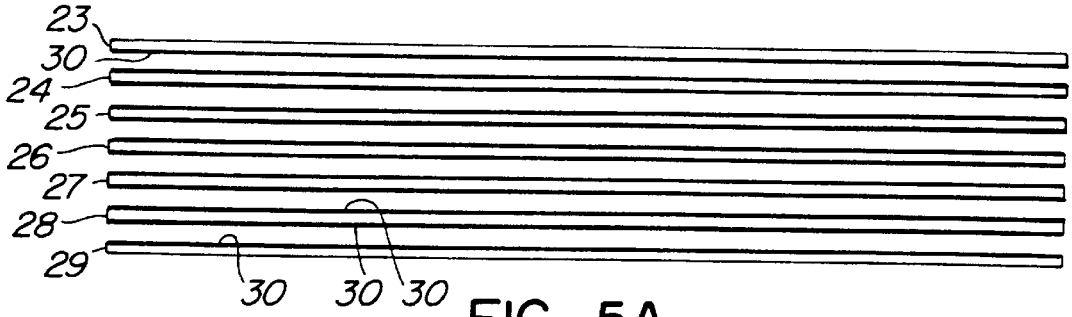
FIGS. 5A through 5E are diagrammatic representations showing the presently preferred way of making the support strip of the bridge of the present invention.
Figure 5B:
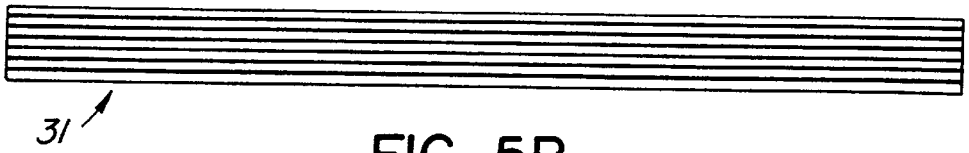

A layer 30 of the glue was applied to the underside of the top veneer 23 and to the top face of the bottom veneer 29. The remaining veneers 24–28 were provided with the glue 30 on both faces. The veneers with the glued faces were then stacked to provide a flat laminate 31 (FIG. 5B).

Figure 5C:
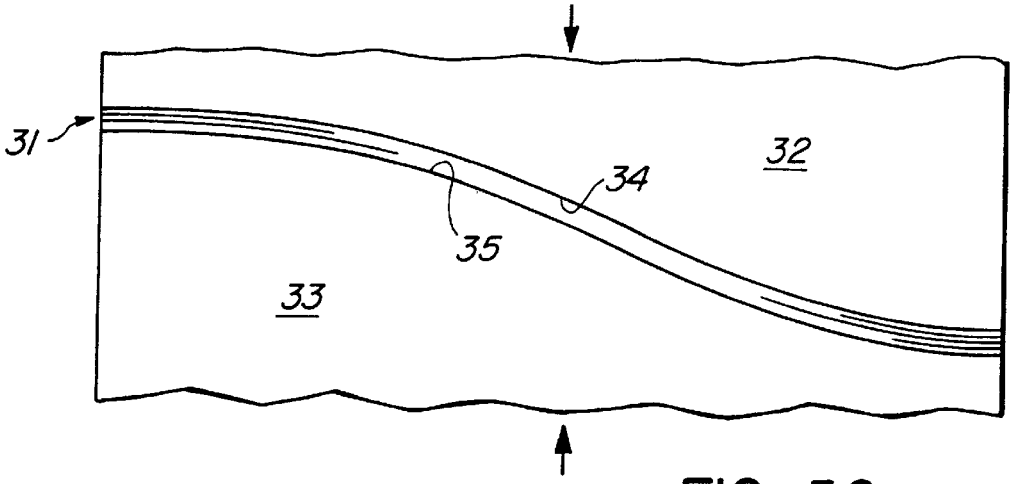
Figure 5D:
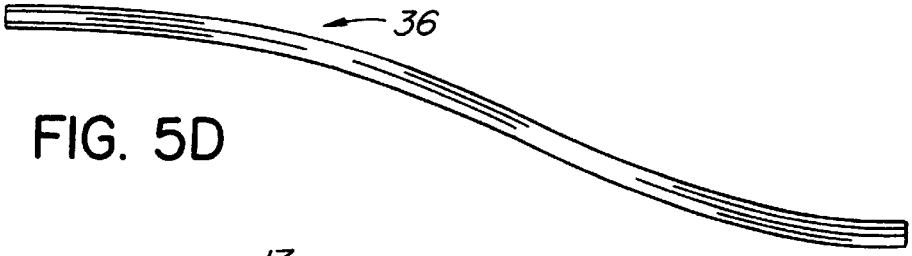
Figure 5E:
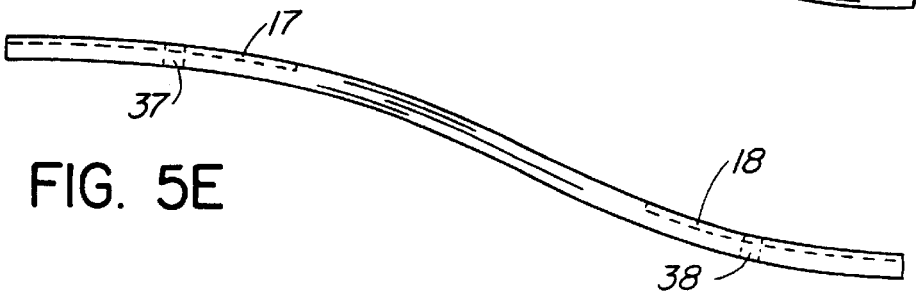

The laminate 31 was then placed in a press jig having an upper form 32 and a lower form 33. The upper form 32 has a curved undersurface 34 and the top surface of the form 33 has a compatibly shaped top surface 35. FIG. 5C shows that the surfaces 34, 35 have a longitudinally arcuate configuration of a flattened S-shape.

The laminate 31 was placed between the surfaces 34 and 35 and the forms 32, 33 pressed to each other, forming the laminate 31 to the same longitudinally arcuate shape.

The laminate 31 was pressed by the jig for about 12 hours. This resulted in the production of an arcuate intermediate product 36 (FIG. 5D) which was then left to dry out for another period of about 12 hours to provide sufficient time for setting of the glue.

Figure 4:
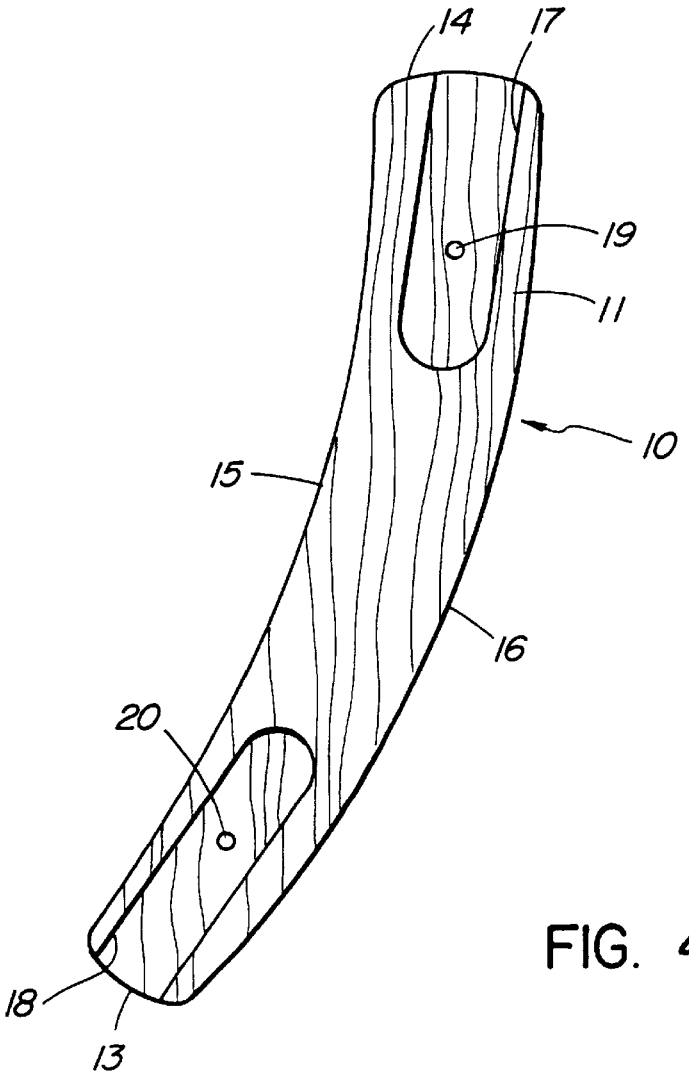
FIG. 4 (on the sheet of FIG. 1) is a top plan view of the bridge of FIG. 1.

Next the side and end edges of the intermediate product 36 were machined to provide the contour of FIG. 4. The elongate grooves 17, 18 were machined in the upper face portion 11. The preferred depth of the grooves 17, 18 corresponds to the thickness of two top layers of veneers 23, 24 so that the flat bottom of the grooves 17, 18 is formed by the veneer 25 having grain oriented in the same direction as that of the top veneer 23.

Holes 37, 38 (FIG. 5E) were drilled in the strip to provide a mounting for the threaded pins 19, 20, preferably of the type having a head and a knurled surface for a strong securement to the strip.

The strip 31 was varnished to make the appearance of the top surface portion 11 similar to the surface of the bottom of the body of a violin.

The foam rubber padding was then adhered to the underside of the bottom veneer layer 29 using contact cement.

The bridge 10 was provided with the clamping members C1, C2 similar to those shown in the above Kun Patent. It yielded good test results in that the bridge had the desired low weight and resiliency while retaining sufficient stiffness to prevent excessive deformation of the bridge where the bridge might strike the bottom of the violin body.

Those skilled in the art will appreciate that the actual configuration of the strip bridge 10 depends on the type of the shoulder rest for which the bridge is made. In particular the type of the clamping members of the shoulder rest may result in an altered structure of the strip. Such changes, however, while departing from the embodiment described, do not depart from the scope of the present invention as set forth in the accompanying claims.

What is claimed is:

1. A shoulder rest for use with a violin or viola, comprising:

(a) an elongated bridge including an upper face portion, a first end portion and a second end portion and two opposed side edge portions;

(b) attachment means for securement of the shoulder rest to a violin or viola, to maintain said bridge spaced below a body of the violin or viola;

(c) said bridge comprising a strip of a laminate, said laminate comprising:

(i) an upper section defined by a plurality of wood veneers and (ii) a lowermost layer defining said lower face portion and being formed by a soft padding adapted to rest on a player's shoulder when the shoulder rest is in use;

(d) said upper section including an uppermost veneer which defines said upper face portion, a lowermost veneer, which is immediately adjacent to said soft padding, and at least one intermediate veneer disposed between said uppermost veneer and said lowermost veneer;

(e) a number of said veneers having their wood grain oriented generally longitudinally, and a number of said veneers having their wood grain oriented generally transversely of the elongation of the bridge;

wherein the grain of the top veneer is oriented generally longitudinally of said bridge.

2. The shoulder rest of claim 1, wherein the grain of the veneer defining said lower face portion is oriented generally longitudinally of said bridge.

3. A shoulder rest for use with a violin or viola, comprising:

(a) an elongated bridge including an upper face portion, a first end portion and a second end portion and two opposed side edge portions;

(b) attachment means for securement of the shoulder rest to a violin or viola, to maintain said bridge spaced below a body of the violin or viola;

(c) said bridge comprising a strip of a laminate, said laminate comprising:

(i) an upper section defined by a plurality of wood veneers and (ii) a lowermost layer defining said lower face portion and being formed by a soft padding adapted to rest on a player's shoulder when the shoulder rest is in use;

(d) said upper section including an uppermost veneer which defines said upper face portion, a lowermost veneer, which is immediately adjacent to said soft padding, and at least one intermediate veneer disposed between said uppermost veneer and said lowermost veneer;

(e) a number of said veneers having their wood grain oriented generally longitudinally, and a number of said veneers having their wood grain oriented generally transversely of the elongation of the bridge;

wherein the grain of the veneer defining said lower face portion is oriented longitudinally of said bridge.

4. A shoulder rest for use with a violin or viola, comprising:

(a) an elongated bridge including an upper face portion, a first end portion and a second end portion and two opposed side edge portions;

(b) attachment means for securement of the shoulder rest to a violin or viola, to maintain said bridge spaced below a body of the violin or viola;

(c) said bridge comprising a strip of a laminate, said laminate comprising:

(i) an upper section defined by a plurality of wood veneers and (ii) a lowermost layer defining said lower face portion and being formed by a soft padding adapted to rest on a player's shoulder when the shoulder rest is in use;

(d) said upper section including an uppermost veneer which defines said upper face portion, a lowermost veneer, which is immediately adjacent to said soft padding, and at least one intermediate veneer disposed between said uppermost veneer and said lowermost veneer;

(e) a number of said veneers having their wood grain oriented generally longitudinally, and a number of said veneers having their wood grain oriented generally transversely of the elongation of the bridge;

wherein the upper face portion is provided, at each end of the bridge, with a longitudinal, shallow groove having a flat bottom and adapted to accommodate attachment means, the depth of the groove being only a small fraction of its width.

5. The shoulder rest of claim 4, wherein the depth of each said groove generally corresponds to the thickness of two uppermost veneer layers, whereby the orientation of the grain of the veneer defining the bottom of the groove has generally the same orientation as that of the top veneer.

6. A shoulder rest for use with a violin or viola, comprising:

(a) a bridge including an upper face portion and an opposed lower face portion, a first end portion and an opposed second end portion, and two opposed side edge portions;

(b) attachment means for securement of the shoulder rest to a violin or viola, to maintain said bridge spaced below a body of the violin or viola;

(c) said bridge including a support strip comprising a laminate of a plurality of wood veneers including a top veneer defining said upper face, a bottom veneer defining the lowermost layer of said strip, and at least one intermediate veneer;

(d) a number of the veneers of said strip having their wood grain oriented generally longitudinally and a number of said veneers having their wood grain oriented generally transversely of the elongation of the bridge;

(e) a soft padding layer fixedly secured to said bottom veneer;

(f) the grain of the top veneer being oriented generally longitudinally of the bridge.

7. A shoulder rest for use with a violin or viola, comprising:

(a) a bridge including an upper face portion and an opposed lower face portion, a first end portion and an opposed second end portion, and two opposed side edge portions;

(b) attachment means for securement of the shoulder rest to a violin or viola, to maintain said bridge spaced below a body of the violin or viola;

(c) said bridge including a support strip comprising a laminate of a plurality of wood veneers including a top veneer defining said upper face, a bottom veneer defining the lowermost layer of said strip, and at least one intermediate veneer;

(d) a number of the veneers of said strip having their wood grain oriented generally longitudinally and a number of said veneers having their wood grain oriented generally transversely of the elongation of the bridge;

(e) a soft padding layer fixedly secured to said bottom veneer;

(f) the grain of the veneer defining said lower face portion being oriented generally longitudinally of said bridge.

8. The shoulder rest of claim 7, wherein the grain of the top veneer and of the lower face portion of said strip being both oriented generally longitudinally of said bridge.

9. A shoulder rest for use with a violin or viola, comprising:

(a) a bridge including an upper face portion and an opposed lower face portion, a first end portion and an opposed second end portion, and two opposed side edge portions;

(b) attachment means for securement of the shoulder rest to a violin or viola, to maintain said bridge spaced below a body of the violin or viola;

(c) said bridge including a support strip comprising a laminate of a plurality of wood veneers including a top veneer defining said upper face, a bottom veneer defining the lowermost layer of said strip, and at least one intermediate veneer;

(d) a number of the veneers of said strip having their wood grain oriented generally longitudinally and a number of said veneers having their wood grain oriented generally transversely of the elongation of the bridge;

(e) a soft padding layer fixedly secured to said bottom veneer;

(f) the upper face portion being provided with, at each end of the bridge, with a longitudinal, shallow groove having a flat bottom and adapted to accommodate attachment means, the depth of the groove being only a small fraction of its width.

10. A shoulder rest of claim 9, wherein the depth of each said groove corresponding to the thickness of two uppermost veneer layers, whereby the orientation of the grain of the veneer defining the bottom of the groove has generally the same orientation as that of the top veneer.

11. For use in making a bridge of a violin or viola shoulder rest, a support strip comprising:

(a) an upper face portion and an opposed lower face portion, a first end portion and an opposed second end portion, and two opposed side edge portions;

(b) said upper face portion being adapted to accommodate attachment means for securement of the support strip to a violin or viola;

(c) said support strip being a laminate of a plurality of wood veneers including a top veneer defining said upper face, a bottom veneer defining said lower face portion and being the lowermost layer of said laminate, and at least one intermediate veneer;

(d) some of said veneers of said laminate having their wood grain oriented generally longitudinally, and some generally transversely of the elongation of the strip;

(e) said strip being longitudinally arcuately curved such that the upper face portion is generally convexly curved and the lower face portion is generally concavely curved;

(f) said top veneer having its grain oriented generally longitudinally of the strip.

12. The bridge of claim 11, wherein the number of the veneers in said laminate is uneven.

13. The support strip of claim 12, wherein adjacent veneers of said laminate have their wood grain oriented alternatively generally longitudinally and generally transversely of the elongation of the strip.

14. For use in making a bridge of a violin or viola shoulder rest, a support strip comprising:

(a) an upper face portion and an opposed lower face portion, a first end portion and an opposed second end portion, and two opposed side edge portions;

(b) said upper face portion being adapted to accommodate attachment means for securement of the support strip to a violin or viola;

(c) said support strip being a laminate of a plurality of wood veneers including a top veneer defining said upper face, a bottom veneer defining said lower face portion and being the lowermost layer of said laminate, and at least one intermediate veneer;

(d) some of said veneers of said laminate having their wood grain oriented generally longitudinally, and some generally transversely of the elongation of the strip;

(e) said strip being longitudinally arcuately curved such that the upper face portion is generally convexly curved and the lower face portion is generally concavely curved;

(f) the upper face portion being provided, at each end of the support strip, with a longitudinal shallow groove having a flat bottom and adapted to accommodate a part of attachment means for securing the support strip to a violin or viola, the depth of the groove being only a small fraction of its width.

15. The support strip of claim 14, wherein the depth of each said groove generally corresponding to the thickness of two uppermost veneers, whereby the veneer defining a flat bottom of each groove has its grain oriented generally longitudinally of the strip.

* * * * *